United States Patent [19]

Ikuta et al.

[11] Patent Number: 4,796,694

[45] Date of Patent: Jan. 10, 1989

[54] COOLING FIN FOR HEAT EXCHANGER

[75] Inventors: Shiro Ikuta; Eizo Suyama; Masaru Yokoyama; Takeshi Yoshimura, all of Tokyo, Japan

[73] Assignee: Nihon Radiator Co., Ltd., Tokyo, Japan

[21] Appl. No.: 869,694

[22] Filed: Jun. 2, 1986

[30] Foreign Application Priority Data

Aug. 26, 1985 [JP] Japan ..... 60-129877[U]

[51] Int. Cl.[4] ..... F28D 1/02

[52] U.S. Cl. ..... 165/152

[58] Field of Search ..... 165/152, 153

[56] References Cited

U.S. PATENT DOCUMENTS

| | | | |
|---|---|---|---|
| 1,726,360 | 8/1929 | Modini | 165/152 |
| 3,265,127 | 8/1966 | Nukol et al. | 165/152 |

FOREIGN PATENT DOCUMENTS

| | | | |
|---|---|---|---|
| 671929 | 12/1929 | France | 165/153 |
| 666956 | 6/1981 | Japan | 165/153 |
| 58-42579 | 3/1983 | Japan | 165/152 |
| 454953 | 3/1983 | Japan | 165/152 |
| 42579 | 3/1983 | Japan | 165/152 |
| 201438 | 11/1967 | U.S.S.R. | 165/153 |

*Primary Examiner*—Michael Koczo
*Assistant Examiner*—Peggy Neils
*Attorney, Agent, or Firm*—Foley & Lardner, Schwartz, Jeffery, Schwaab, Mack, Blumenthal & Evans

[57] ABSTRACT

In order to increase the heat exchange capacity and efficiency of a cooling fin for an automotive radiator, air conditioner heat exchanger, or the like, a plurality of small triangular or similar shaped projections which produce a texture similar to that of a vegetable grater, are arranged to project into the flow of a fluid medium which passes over the fin in a manner to split a part of the flow into spiralling flow patterns which curl along the surface of fin downstream of the projections and transfer heat from said surface to the fluid medium or vice versa.

16 Claims, 3 Drawing Sheets

COOLING FIN FOR HEAT EXCHANGER

BACKGROUND OF THE PRESENT INVENTION

1. Field of the Invention

The present invention relates generally to a heat exchanger and more specifically to a fin arrangement for a heat exchanger which is exposed to a flow of fluid medium.

2. Description of the Prior Art

In order to increase the heat exchange capacity of a heat exchanger such as an air-cooled radiator for use with automotive vehicles it has been been necessary to add fins to the tubing of the radiator through which the heated fluid is passed. To increase the heat exchange characteristics of the finning various louver arrangements have been proposed.

FIGS. 2 and 3 show one of two previously proposed arrangements disclosed in Japanese Utility Model First Provisional Publication No. 58-42579. In this first arrangement a plurality of air-scoop like louvers 10 are formed in the fin 12 to increase the interaction and contact between the cooling medium and the surfaces of the fins. These fins 12 are arranged to be elongate, folded in a serpentine configuration and disposed between adjacent conduits 14 which convey heated fluid from the upper tank to the lower one of the radiator R shown in FIG. 1.

However, as will be appreciated from FIG. 2, with this arrangement the provision of the louvers 10 reduces the clearance between the folded sections of the fins 12 and thus increases the resistance to the flow of air through the device undesirably.

FIGS. 4 to 6 shows the second of the two arrangements disclosed in the above mentioned reference. This arrangement features the provision of a plurality of triangular sub-fins 20 in a serpentine shaped fin arrangement 22. As shown in FIG. 5 the sub-fins 20 are formed in first and second groups, viz., groups A and B. The sub-fins 20 in the downstream group A are angled in a manner which tends to induce the air flowing through the radiator to strike against the upstream faces or surfaces thereof and induce some of the flow to pass through the apertures formed when the fins are pressed. On the other hand, the fins in the upstream bank or group B are angled in the reverse direction and thus tend to project into the flow in manner which increases the contact between the air and surface of the fins.

With this type of arrangement the greater the surface area and the steeper the angle at which the sub-fins 20 extend from the main fin body 22, the greater the effect. However, these requirements tend to unacceptably increase the air-flow resistance of the arrangement as a whole. Accordingly, the angle at which the fins are formed and the size thereof in this second arrangement is a compromise between flow resistance and heat exchange effectiveness.

SUMMARY OF THE INVENTION

It is an object of the present invention to provide an improved fin arrangement for a heat exchanger such as an automotive radiator, an air conditioner heat exchanger, or the like, which increases the heat exchange capacity of the fins without increasing the resistance to fluid flow between adjacent fins.

In brief, the above object is achieved by an arrangement wherein a plurality of small triangular or similar shaped projections which produce a texture similar to that of a vegetable grater, are arranged to project into the flow of a fluid medium which passes over the fin in a manner to split a part of the flow into spiralling flow patterns which curl along the surface of fin downstream of the projections and which promote the transfer of heat between the medium and the surface.

More specifically, the present invention takes the form of fin arrangement for a heat exchanger which is characterized by: a plurality of tubes through which a working fluid flows, the plurality of tubes being spaced by a predetermined distance; a fin connected with and extending between the plurality of tubes, the fin transferring heat to or from the tubes via conduction; means formed with the fin for causing a plurality of spiral flow patterns in a flow of the fluid medium which flows over the major surfaces of the fin, the spiral flow causing means comprising: a plurality of shaped projections which extend from the surface of the fin at a predetermined angle, each of the shaped projections being oriented to split the flow of fluid medium which contacts the same into spiralling flows which contact the surface of the fin at locations downstream of the projection, the projections being formed in a manner that a plurality thereof are located along the fin per each predetermined distance.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENT

Before proceeding with a detailed description of the embodiments of the present invention, it is deemed appropriate for developing an appreciation of the mode via which the present invention achieves a remarkable increase in heat exchange efficiency without incurring any undesirable increase in flow resistance of the heat exchanger to the natural drafts of air (by way of example) which are available when an automotive vehicle is driven, to firstly consider the fundamental discovery that underlies the present invention.

The present invention is based on the discovery that by angling a projection at a suitable angle into a flow of air (or similar fluid medium) a spiralling air flow pattern can be produced which adheres to the surface of a member (heating exchange fin) downstream of the projection in a manner which promotes the transfer of heat between the member and the flow of fluid medium.

Figure 1:
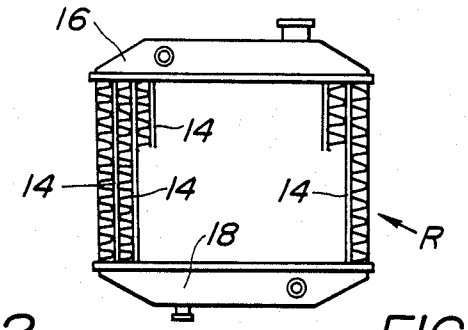
FIG. 1 shows a heat exchanger of the type to which the present invention is applicable.
Figure 2:
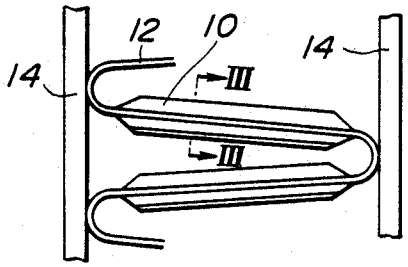
FIG. 2 (PRIOR ART)
FIGS. 2 and 3 show the first of the prior art arrangements discussed in the opening paragraphs of the instant disclosure in connection with Japanese Utility Model First Provisional Publication No. 58-42579.
Figure 3:
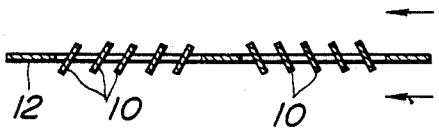
FIG. 3 (PRIOR ART)
Figure 4:
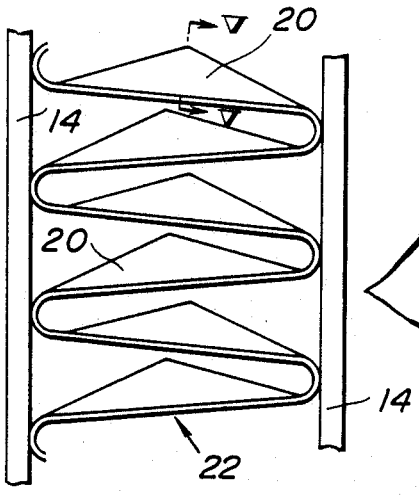
FIG. 4 (PRIOR ART)
FIGS. 4 to 6 show a second of the prior art arrangements discussed in the above mentioned connection with said publication.
Figure 5:
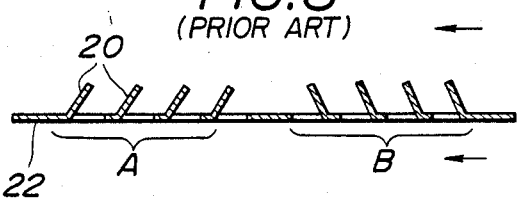
FIG. 5 (PRIOR ART)
Figure 6:
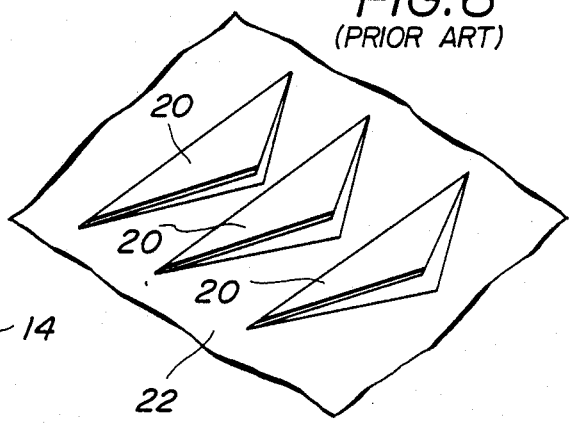
FIG. 6 (PRIOR ART)
Figure 7:
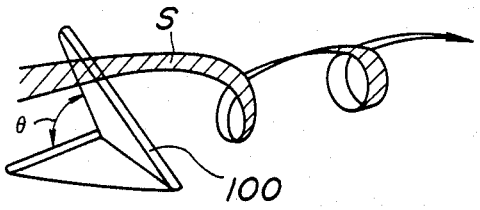
FIGS. 7 and 8 shows perspective and plan views of a projection which produces the spiralling flow patterns which characterize the present invention.
Figure 8:
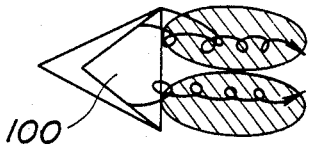

FIGS. 7 and 8 illustrate such a projection 100 and the flow which characterizes the present invention.

As shown in FIG. 7, the spiralling air flows S which are formed in the flow of fluid medium downstream of the projection 100 are such as remove heat from the zones indicated in hatching.

Experiments have revealed that a triangular shaped projection produced the best results when angled in a range of 15°–45°. The reason for this is that as shown the sharp leading edge of the triangular shape projects above the level of the major surface of the fin and thus splits the flow of air striking thereagainst which subsequently curls over onto the downstream face of the fin thus forming the spiralling flows which adheres to the surface of the fin and which characterizes the present invention.

Figure 9:
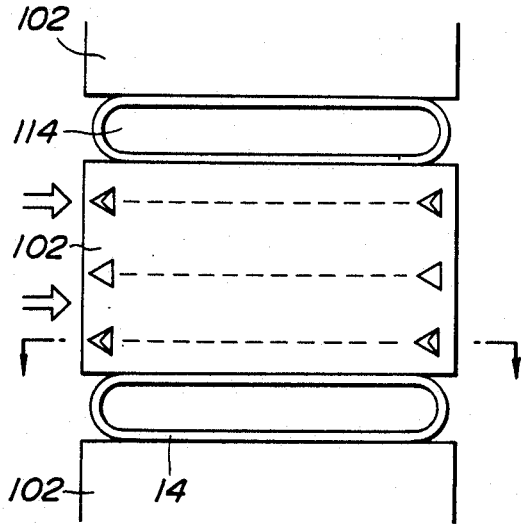
FIGS. 9 and 10 show in plan and sectional elevation respectively the arrangement a first embodiment of the present invention.
Figure 11:
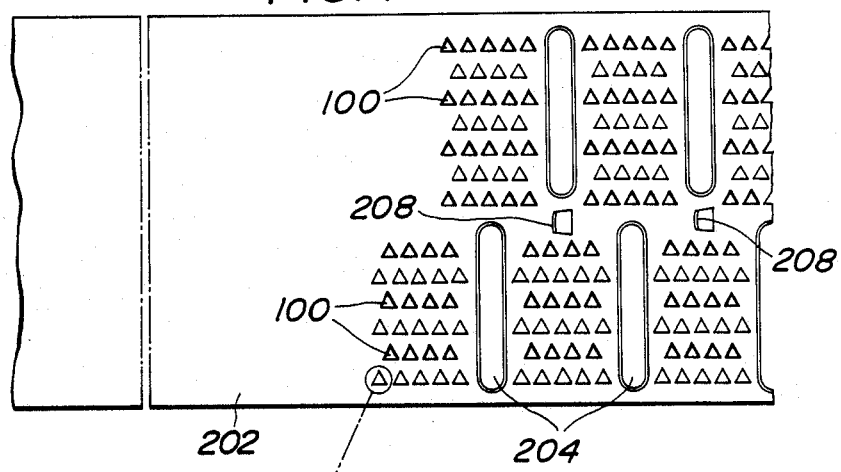
FIGS. 11 to 13 are plan and perspective views of a second embodiment of the present invention.

These experiments also revealed that a large number of small projections promoted the best heat removal from the fins. In the embodiments of the invention set forth hereinlater, the main factor which limits the number of projections per unit length (viz., pitch) is currently used pressing techniques wherein in order to avoid tearing of the sheet of metal in which the projections are formed, a clamp member is applied on either side of the aperture which results when the projection is pressed out. Accordingly, as shown in FIGS. 9 and 11 for example, a space approximately equal to the maximum width of each projection is provided between each of the projections. With the development of improved pressing techniques this space can be reduced in a manner to increase the number of projections which can be formed per unit length.

Figure 10:
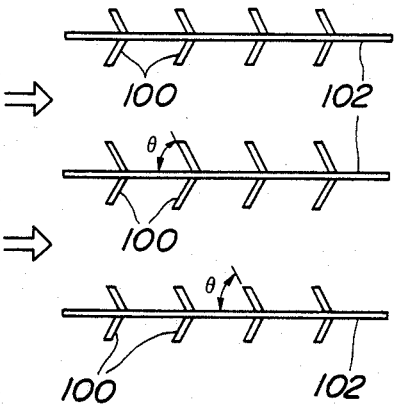

FIGS. 9 and 10 show a first embodiment of the present invention. In this arrangement the fin 102 is formed of an elongate strip which is pressed to form a plurality of rows of spiral flow generating sub-fins 100. To ensure that heat exchange is conducted on both major surfaces of the fin the sub-fins are arranged to be pressed to project from both sides of the strip. In this embodiment each alternative fin is pressed in the same direction.

Following the pressing operation the fin 102 is folded into a serpentine shape and disposed between the tubes 14 which extend between the upper and lower tank 16, 18 of the radiator R and suitably connected thereto to ensure that heat is readily transferred therebetween.

Figure 12:
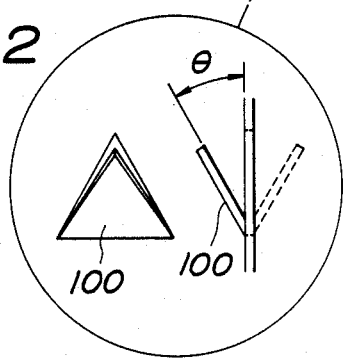
Figure 13:
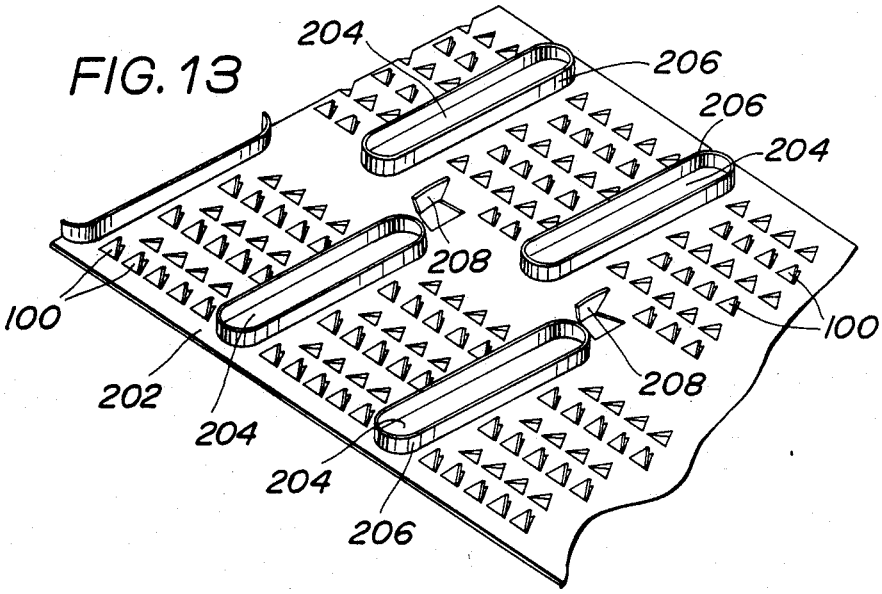

FIGS. 11 to 13 show a second embodiment of the present invention. This arrangement differs from the first embodiment in that the fins 202 are formed as elongate straight stips which are additionally formed with elongate apertures 204 through which the tubes 14 of the radiator are disposed. As shown in FIG. 13 the pressing of these apertures forms flanges 206 which engage the sides of the tubes 14 in a manner which ensures good heat transfer conduction therebetween.

This embodiment is further formed with projection members 208. These members act as spacers which ensure that a predetermined space is provided between adjacent fins when a stack of the same are disposed one on top of the other during the heat exchanger (e.g. radiator) production. As will be appreciated this embodiment is adapted for for use with a radiator wherein the rows of tubes are employed.

In this embodiment the sub-fins are formed to define a 30° angle with respect to the major surfaces of the fin.

As will be appreciated from FIG. 11 the large number of sub-fins 100 induces the fin to resemble a vegetable grater and hence has been dubbed the "grater fin" due to its similarity in texture to this type of utensil.

The above disclosed embodiments are exemplary of the present invention is limited only by the appended claims.

What is claimed is:

1. In a heat exchanger a plurality of tubes through which a working fluid flows, said plurality of tubes being spaced apart from one another by a predetermined distance;

a fin connected with and extending between said plurality of tubes, said plurality of tubes and said fin being arranged so that heat is exchanged therebetween via conduction, said fin being exposed to a flow of fluid medium with which heat exchange is to be effected;

means formed on said fin for causing a plurality of spiral flow patterns in a flow of medium which flows over first and second major surfaces of said fin, said spiral flow causing means comprising:

a plurality of shaped projections each which extend from one of said first and second major surfaces of said fin at a predetermined angle, each of said shaped projections being oriented to split the flow of the fluid medium which contacts the same, into at least two spiralling flows which curl in toward each other downstream of the projection and subsequently contact the major surface of said fin form which each of said shaped projections extend at locations separate from and downstream of said projections, said projections being formed in a manner that a plurality thereof are provided per said predetermined distance by which said plurality of tubes are spaced apart from one another.

2. A heat exchanger as claimed in claim 1, wherein each of said projections has a triangular configuration and is oriented to point into the flow of cooling medium, said projections being arranged at a predetermined angle with respect to at least one of said first and second major surfaces of said fin.

3. A heat exchanger as claimed in claim 1, wherein each of said projections has a triangular configuration, a first group of said projections being arranged to project from said first major surface of said fin and a second group from said second major surface, the projections of said first and second groups being arranged at a predetermined angle with respect to the respective major surfaces from which they project, the projections of said first and second groups being oriented to point into the flow of cooling medium.

4. A heat exchanger as claimed in claim 2, wherein said fin is configured to assume an essentially serpentine shape and disposed between adjacent tubes.

5. A heat exchanger as claimed in claim 2, wherein said fin is formed as a flat sheet which is provided with apertures through which said tubes can be receivingly disposed.

6. A heat exchanger as claimed in claim 1, wherein at least 3 projections are formed in said fin per said predetermined distance.

7. In a heat exchanger first and second conduits through which a first fluid flows, said conduits being spaced apart from one another by a predetermined distance;

a fin extending between said conduits, said conduits and said fin being arranged so that heat is exchanged therebetween via conduction and to be exposed to a flow of a second fluid, said fin having first and second major surfaces;

a plurality of projections extending from said first and second major surfaces of said fin per said predetermined distance for splitting the flow of said second fluid into spiraling flows which both adhere to a flat peripheral surface of at least one of said first and second major surfaces of said fin at locations downstream of said projections, said spiraling flows exhibiting essentially no adherence with said projections and inducing essentially all heat exchange between said second fluid and said fin to occur at said downstream locations.

8. A heat exchanger as claimed in claim 7, wherein each said splitting means splits the flow into pairs of essentially mirror image spiraling flows.

9. In a heat exchanger first and second conduits through which a first fluid flows, said conduits being spaced apart by predetermined distance;

a fin extending between said conduits, said fin having a major surface, said conduits and said fin being arranged so that heat is exchanged therebetween via conduction and to be exposed to a flow of a second fluid;

a plurality of projections extending from said major surface of said fin along said predetermined distance between said first and second conduits, said projections being arranged to split the flow of the second fluid into pairs of essentially mirror image spiraling flows which adhere to essentially flat peripheral surfaces of the same major surface of said fin downstream of the projection, said spiral flows undergoing essentially no adherence to the projections, said spiral flows inducing a heat exchange between said second fluid and the major surface of said fin at locations downstream of said projections, said projections being formed so that they are small and that as many as possible are formed on said fin per unit area.

10. A heat exchanger as claimed in claim 1, wherein said predetermined angle is in a range between about 15° to 45°.

11. In a heat exchanger first and second essentially parallel conduits through which a first fluid flows, said conduits being spaced apart by a predetermined distance;

a fin in heat exchange contact with said first and second conduits, said fin extending between said conduits and having a first essentially flat major surface, said fin being exposed to a flow of a second fluid;

a pluraity of means along said predetermined distance for splitting the flow of said second fluid into a plurality of pairs of essentially mirror image spiraling flows, said spiraling flows adhering to an essentially flat surface of said first major surface which is peripheral to said splitting means and inducing a heat exchange between said second fluid and the essentially flat peripheral surface.

12. A heat exchanger as claimed in claim 11 wherein said fin has a second essentially flat major surface and wherein said splitting means causes a plurality of pairs of essentially mirror image spiralling flows which adhere to said second major surface and induce a heat exchange between said second fluid and said second major surface.

13. A heat exchanger as claimed in claim 11 wherein said splitting means comprises a plurality of first projections which extend above said first major surface and which are arranged in said predetermined distance.

14. A heat exchanger as claimed in claim 12 wherein said splitting means comprises a plurality of second projections which are essentially identical to said first projections, said second projections projecting above said second major surface and arranged in said predetermined distance.

15. A heat exchanger as claimed in claim 7 wherein said predetermined distance is the shortest distance which can be measured between said first and second conduits.

16. In a heat exchanger an upper header tank;

a lower header tank;

first and second essentially parallel tubes extending between and fluidly interconnecting said upper and lower headers, first and second tubes being separated by a predetermined distance;

a serpentine strip disposed between said first and second tubes, said serpentine strip being arranged in a manner that heat can be transferred between itself and said first and second tubes;

a plurality of means along said predetermined distance defining small projections per unit area of said serpentine strip, said projections each being arranged to project above an essentially flat major surface of the strip and to split the flow of a medium which flows over said strip and said first and second tubes into first and second essentially mirror image spiral flows, said first and second spiral flows contacting and inducing heat exchange with an essentially flat peripheral area of said strip at a location downstream of and separate from said projection.

* * * * *